US007249964B1

(12) United States Patent
Hoffman et al.

(10) Patent No.: US 7,249,964 B1
(45) Date of Patent: Jul. 31, 2007

(54) WIRING HARNESS CONNECTOR STRAIN RELIEF

(75) Inventors: Edward K. Hoffman, Anaheim, CA (US); Brian J. Hupf, Garden Grove, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 11/343,577

(22) Filed: Jan. 31, 2006

(51) Int. Cl.
*H01R 13/58* (2006.01)

(52) U.S. Cl. ..... 439/471; 439/464

(58) Field of Classification Search ..... 439/449, 439/464, 470, 471
See application file for complete search history.

(56) References Cited

U.S. PATENT DOCUMENTS 4,653,836 A * 3/1987 Peele ..... 439/610
4,722,580 A * 2/1988 Kocher et al. ..... 439/466
4,786,260 A * 11/1988 Spaulding ..... 439/607
5,199,903 A * 4/1993 Asick et al. ..... 439/610
5,409,400 A * 4/1995 Davis ..... 439/610
5,547,388 A * 8/1996 Hill ..... 439/135
5,700,156 A * 12/1997 Bussard et al. ..... 439/471
6,259,028 B1 * 7/2001 Senma ..... 174/72 A

* cited by examiner

*Primary Examiner*—Thanh-Tam Le
(74) *Attorney, Agent, or Firm*—Donald C. Lawrence; MacPherson Kwok Chen & Heid LLP

(57) ABSTRACT

A device for providing strain relief between an electrical connector and a wiring harness having wires or cables already joined to the contacts of the connector includes a T-shaped plate having axial and transverse members and a pair of opposing, inwardly facing, U-shaped structures disposed at opposite ends of the transverse member and extending at a right angle to the plate from a front edge thereof. The device is mounted on the connector with the U-shaped structures respectively straddling a corresponding mounting flange of the connector and a distal end portion of the axial member extending rearward over a portion of the harness extending rearward from the connector. The two rearward extending portions of the plate and harness are cinched together with a strap or the like. The device can be installed after the harness has been assembled without the need to remove the wires or contacts from the connector.

20 Claims, 4 Drawing Sheets

WIRING HARNESS CONNECTOR STRAIN RELIEF

STATEMENT REGARDING FEDERALLY SPONSORED RESEARCH OR DEVELOPMENT

This invention was made with Government support under contract no. F33657-00-C-5219. The Government has certain rights in this invention.

TECHNICAL FIELD

This application pertains to electrical wiring harnesses in general, and in particular, to a connector-to-wiring harness strain relief apparatus that can be retrofitted to a wiring harness after the harness is fully assembled.

BACKGROUND

Wiring harnesses are used extensively in both commercial and military aviation and space applications to interconnect physically separate subassemblies of an electronics system. A wiring harness typically comprises a bundle of insulated wires or cables of various well-known types, each of which terminates at its opposite ends in a respective contact of an electrical connector of various known types, and may include one or more "branches" that extend from a main bundle and terminate in an electrical connector. One such harness connector that is used widely in both airborne and space applications is the military standard Mil-DTL-24308 connector, more widely referred to as a "D-subminiature," or simply, "D-sub" connector.

D-sub connectors are provided in complementary, mating, i.e., male-female, pairs of connectors, each comprising a plurality, typically between 9 and 78, of either pins or sockets, typically of copper alloy, that are encased in a dielectric insert, typically plastic, that is surrounded by a shell, typically metal, that is "D" shaped for "polarization" purposes, i.e., such that the connector pair can mate with each other in only one, correct, engagement. The shell includes a pair of mounting flanges disposed on opposite sides of the insert, and each flange is typically provided with an aperture containing one of a pair of complementary, captivated fasteners, e.g., a threaded nut-and-screw pair, that can be used both to mount the respective connector halves to, e.g., a mounting surface, and also to pull the two halves into operative engagement with each other.

In one typical application of D-sub connectors, a half of a mating pair of the connectors is mounted in an opening in a front or rear panel of an electronics unit, and wires or cables conveying electrical signals to or from the interior of the unit are respectively coupled to the back ends of the contacts, i.e., the pins or sockets, thereof. A wiring harness containing a bundle of wires and cables, each respectively coupled to the back ends of the contacts of the other half of the mating connector pair, is arranged to convey the respective signals of the unit to or from the other units of the system. The wiring harness thus defines a simple, convenient and reliable signal interface that enables each of the subassembly units of the system to be easily and quickly electronically coupled to or decoupled from the system and, e.g., replaced with another unit for maintenance and repair purposes.

Although wiring harnesses can provide convenient, reliable electrical interfaces between the units of an electronics system, they are subject to certain recognized problems that are inherent thereto. One of these relates to the strain that can be imposed on the connection between the contacts of the connectors and the wires or cables of the harness due to forces being applied to one of the connector or the wire bundle independently of the other. This can result, for example, from shock and/or vibration forces acting on the harness during flight, or as a result of maintenance personnel tugging on the harness to reroute it, or to disengage a connector of the harness from engagement with a mating panel connector. In such instances, it is possible in some cases for the resulting strain between the connector and the harness to break some of the wires of the harness, or to disconnect them from their respective connector contact.

In light of this problem, it is known to provide a stress relief mechanism on a harness connector that enables the connector and the harness to be coupled together mechanically at the rear of the connector, such that forces applied to either of the two is transmitted directly to the other through the strain relief mechanism, rather than through the connections of the wires to the respective connector contacts. However, connectors provided with such strain relief mechanisms are typically heavier and more expensive than those without them, and are often not utilized where weight is of a concern. Additionally, such connectors must be installed on the harness at the time the harness is initially fabricated, so that a later decision to retrofit a wiring harness with such connectors necessitates a complete disassembly of all of the wires of the harness from the contacts of the existing connectors, and a reassembly of the wires with the contacts of the new connectors, a costly and time-consuming procedure.

Accordingly, there is a long felt but as yet unsatisfied need in this field for an inexpensive, reliable and light weight strain relief mechanism for a wiring harness connector that can be installed on or removed from the connector and harness either at the time the harness is fabricated, or later, e.g., after the harness has been deployed in the field, quickly and simply, and without the need to remove all of the wires or contacts from the connector.

BRIEF SUMMARY

In accordance with the exemplary embodiments of the present invention disclosed herein, an apparatus is provided for effecting strain relief between a wiring harness and a connector thereof that can be quickly and easily installed on or removed from the connector and harness, either at the time the harness is fabricated or at any time thereafter, without necessitating the removal of the wires or contacts from the connector.

In one exemplary embodiment, the strain relief apparatus comprises a T-shaped plate having an axial member, a transverse member, and a pair of inwardly facing, U-shaped structures that are disposed in opposition to each other at opposite ends of the transverse member, and that extend at a right angle to the plate from a front edge thereof. Each of the U-shaped structures includes a pair of parallel front and rear flanges that are spaced apart so as to straddle a corresponding mounting flange of the connector. Each of the front and rear flanges includes a U-shaped slot that is aligned with an aperture in the corresponding connector mounting flange when the latter is disposed between the two flanges, and the front flange slot is made slightly larger than the rear flange slot to clear a mounting fastener of a mating connector.

In use, the exemplary apparatus is disposed on the harness connector such that the transverse member of the plate overlies the connector, the U-shaped structures respectively straddle a corresponding mounting flange of the connector, and a distal end portion of the axial member of the plate overlies a portion of the harness extending rearward from the connector in a generally parallel relationship. A mounting fastener is inserted through each of the connector flange apertures and the corresponding apparatus rear flange slots, and is preferably captivated therein, e.g., with a plate nut, such that a front surface of each of the rear flanges of the U-shaped structures is held against a rear surface of the corresponding connector mounting flange. The portion of the harness that extends rearward from the connector is then firmly cinched to the distal end portion of the elongated portion of the plate, e.g., with a tying strap or a compressive band, to provide robust strain relief between the harness and the connector.

Advantageously, the apparatus can be inexpensively die-stamped from a sheet of metal, e.g., a mild steel or an aluminum alloy, as a single piece, and then formed up with simple tooling to incorporate all of the foregoing features, and more advantageously, can be quickly and easily installed on or removed from a wiring harness and connector, either at the time the harness is fabricated or at any time thereafter, e.g., in the field, without the necessity of removing all of the wires or contacts from the connector.

A better understanding of the above and many other features and advantages of the apparatus of the present invention and methods of its use may be obtained from a consideration of the detailed description of the exemplary embodiments thereof below, particularly if such consideration is made in conjunction with the appended drawings, wherein like reference numerals are used to identify like elements illustrated in one or more of the figures therein.

DETAILED DESCRIPTION

Figure 1:
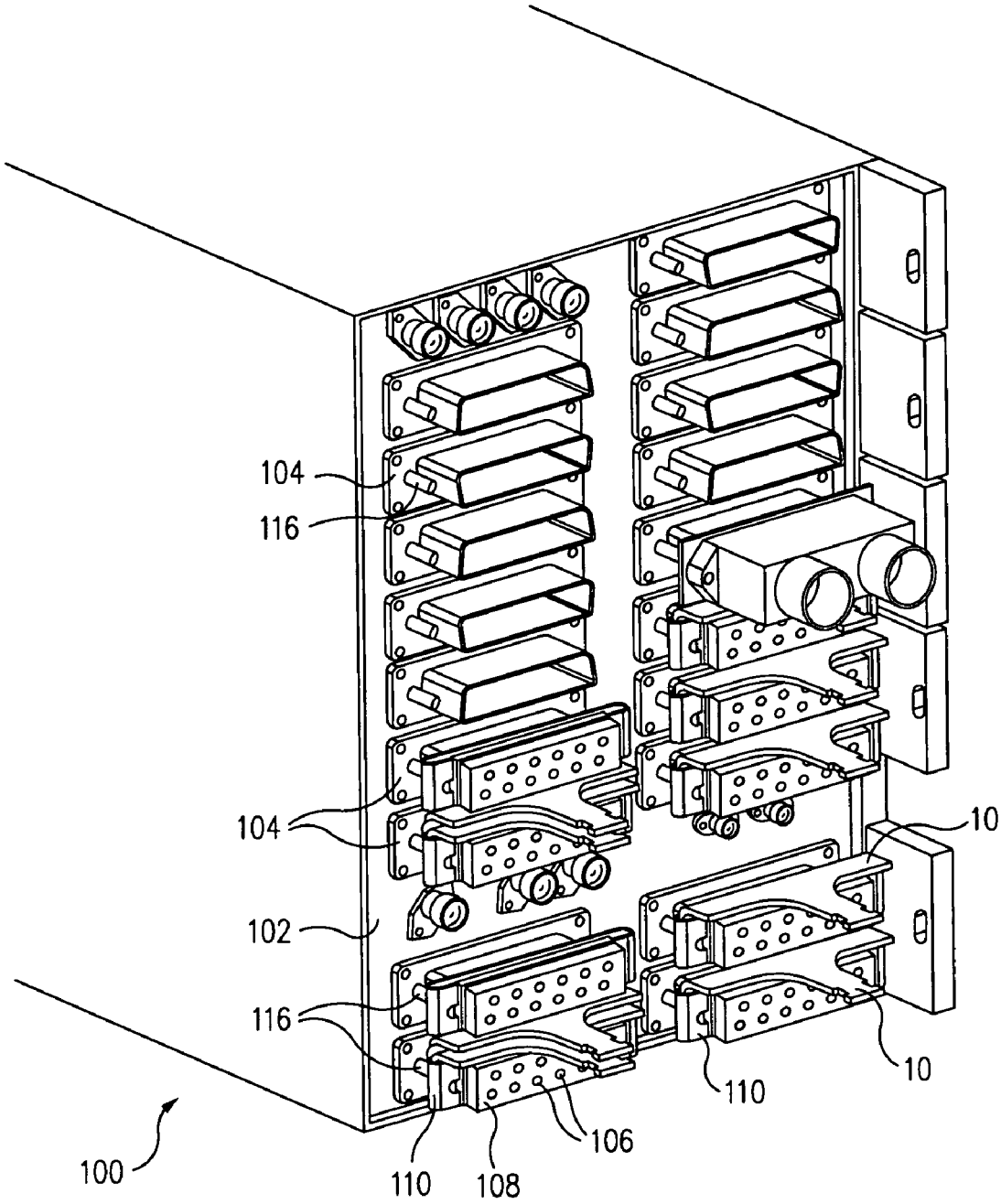
FIG. 1 is a partial upper right front perspective view of an electronics unit having a front panel with a plurality of electrical connectors mounted thereon, showing an exemplary embodiment of the wiring harness strain relief apparatus of the present invention mounted on connectors of a wiring harness engaging some the front panel connectors, and wherein the wires and cables of the harness have been omitted for clarity.
Figure 2:
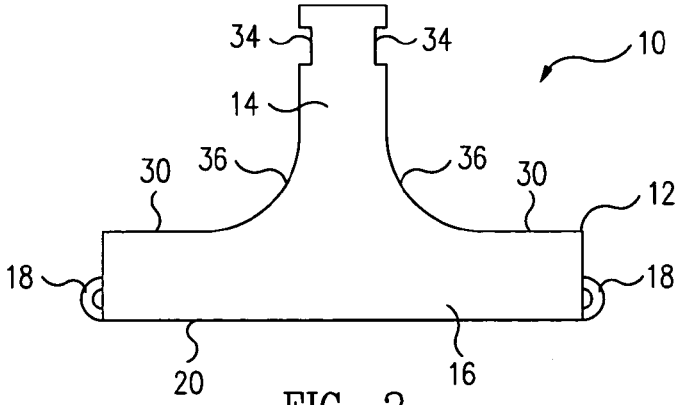
FIGS. 2-4 are top plan, front elevation, and bottom plan views, respectively, of the strain relief apparatus of FIG. 1.

FIG. 1 is a partial perspective view of a subassembly unit 100 of an electronics system having a front panel 102 with a plurality of connectors, including D-sub connectors 104, mounted thereon. Wires or cables convey electrical signals to or from components in the interior of the unit to the back ends of respective contacts, i.e., pins or sockets (not seen in FIG. 1), which are contained in dielectric inserts of the front panel connectors. A wiring harness is arranged to convey the signals present on the front panel connector contacts to or from other units of the system, and comprises a bundle of wires and cables (omitted for clarity in FIG. 1) that respectively connect to the back ends of contacts 106 encased in dielectric inserts 108 of harness connectors 110 that are configured to mate in operative engagement with the front panel connectors. The wires of the harness extend out rearward from the harness connectors and are gathered in bundles that branch out to interconnect with the other units of the system.

During use of a wiring harness, it is possible for forces to be applied to one of a harness connector 110, or to the wire bundle extending rearward from it, in a differential manner, i.e., without the forces being applied equally to the other. This can result, for example, from shock and/or vibration forces acting on the harness during flight of an aircraft or space vehicle, or as a result of ground personnel pushing or pulling on the harness to reroute it, or to disengage a harness connector from engagement with a mating front panel connector 104. This differential in application of forces results in a strain being imposed on the respective connections between the contacts of the connectors and the wires or cables of the harness, and in some cases, it is possible for this strain to break some of the wires of the harness, or disconnect them from their respective connector contacts.

Figure 5:
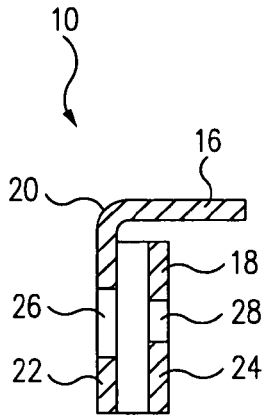
FIG. 5 is a cross-sectional view of the apparatus, as seen along the section lines 5-5 of FIG. 3.

An exemplary embodiment of a wiring-harness-to-connector strain relief apparatus 10 in accordance with the present invention, and which can substantially reduce if not eliminate the foregoing problem, is illustrated in the top plan, front elevation, bottom elevation, and right side elevation vies of FIGS. 2-4 and 6, respectively. The apparatus 10 comprises a T-shaped plate 12 having an elongated axial member 14, a transverse member 16, and a pair of inwardly facing, U-shaped structures 18 that are disposed in opposition to each other at opposite ends of the transverse member, and that extend at a right angle to the plate from a front edge 20 thereof. Each of the U-shaped structures includes a pair of parallel front and rear flanges 22 and 24 (see FIG. 5) that are spaced apart so as to straddle a corresponding mounting flange 112 of a wiring harness connector 110 (see FIG. 8). As illustrated in the front elevation and cross-sectional views of FIGS. 3 and 5, each of the front and rear flanges includes a respective U-shaped slot 26 and 28 that aligns with an aperture 114 in the corresponding connector mounting flange when the latter is disposed between the two flanges (see FIGS. 8 and 9). Additionally, the front flange slot 26 is made slightly larger than the rear flange slot 28 to provide clearance for a complementary mounting fastener 116 disposed on the mounting flange of a mating panel connector 104 (see FIG. 1).

As may generally be seen in the figures, the transverse member 16 of the plate 12 plate has a length and width respectively corresponding to a length and width of the harness connector 110, and the elongated axial member 14 is coplanar with and extends rearward from a rear edge 30 of the transverse member 16. As illustrated in FIGS. 10-13, the axial member is arranged so as to overlie a portion of a wiring harness, or wire bundle 32, extending rearward from the connector in a generally parallel relationship. As illustrated in, e.g., FIG. 2, in the exemplary embodiment, the axial member 14 includes a pair of notches 34 disposed in opposite sides and adjacent to a distal end thereof to provide a feature for catching a tying wrap or band 36 used to cinch the harness to the axial member of the apparatus 10, as illustrated in FIGS. 10-13. To provide rigidity to the axial member against bending in a direction perpendicular to the plate 12, the axial member preferably intersects the transverse member in a radius 36 on each of the opposite sides of the member, as illustrated in, e.g., FIGS. 2 and 4.

Figure 3:
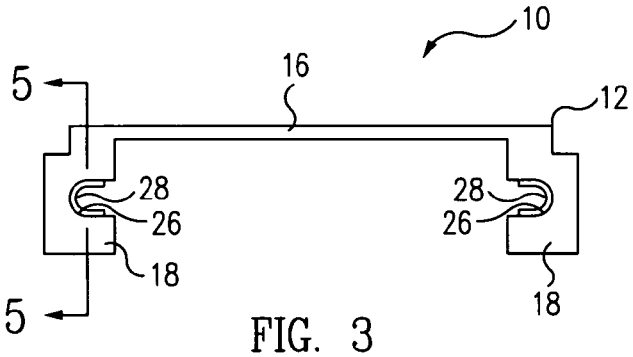
Figure 6:
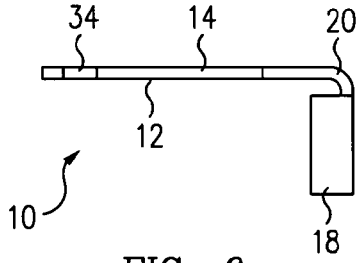
FIG. 6 is a right side elevation view thereof.
Figure 4:
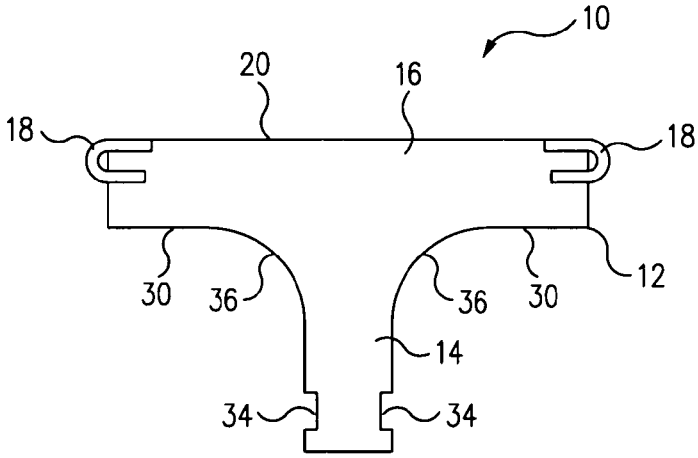
Figure 9:
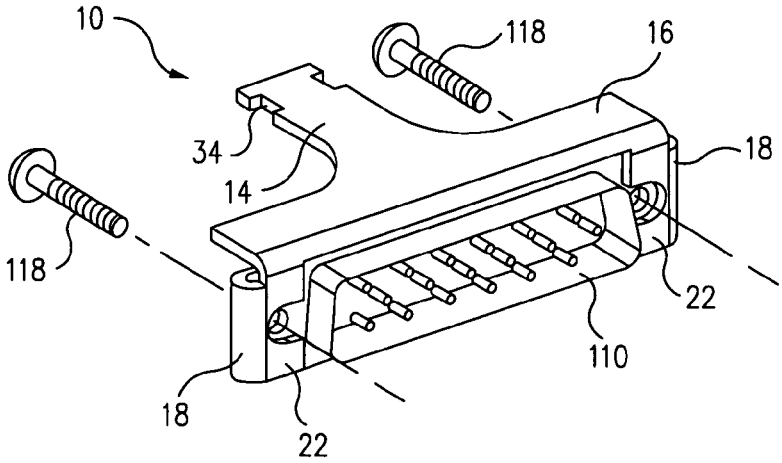
Figure 10:
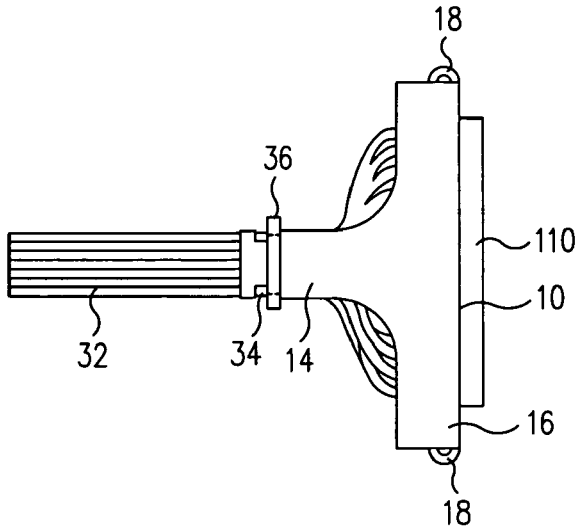
FIGS. 10 and 11 are top plan and right side elevation views, respectively, showing the strain relief apparatus installed on a connector of a wiring harness.
Figure 11:
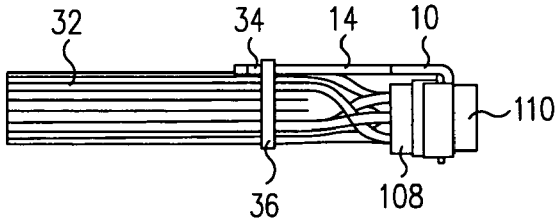
Figure 12:
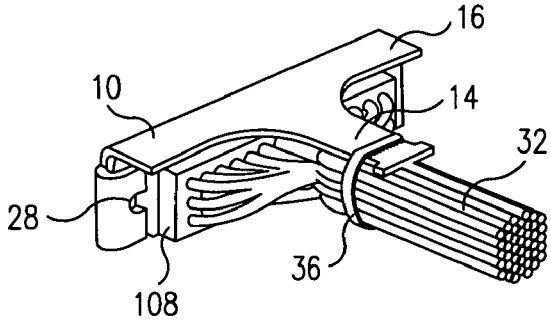
FIG. 12 is an upper left rear perspective view showing the apparatus installed on a connector of a wiring harness; and, FIG. 13 is an upper right front perspective view showing the apparatus installed on a connector of a wiring harness.
Figure 13:
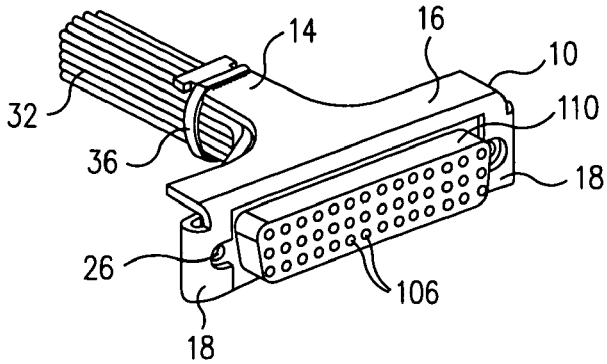

With reference to FIGS. 3, 9 and 13, it may be seen that the front face of the apparatus defines a three-sided, rectangular window that is adapted to slip down over and frame the front face of the corresponding harness connector 110 on three sides without the need to remove any of the wires or contacts from the connector, and without affecting the ability of the connector to engage correctly with a mating panel connector 104 (see FIG. 1).

Figure 7:
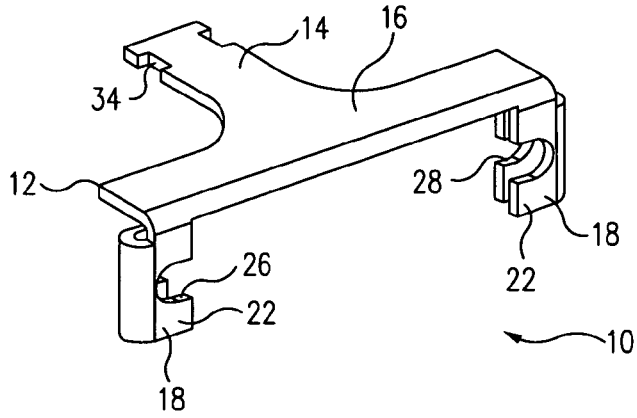
FIGS. 7-9 are upper right front perspective views showing the sequential steps of installing the strain relief apparatus on a connector of a wiring harness.
Figure 8:
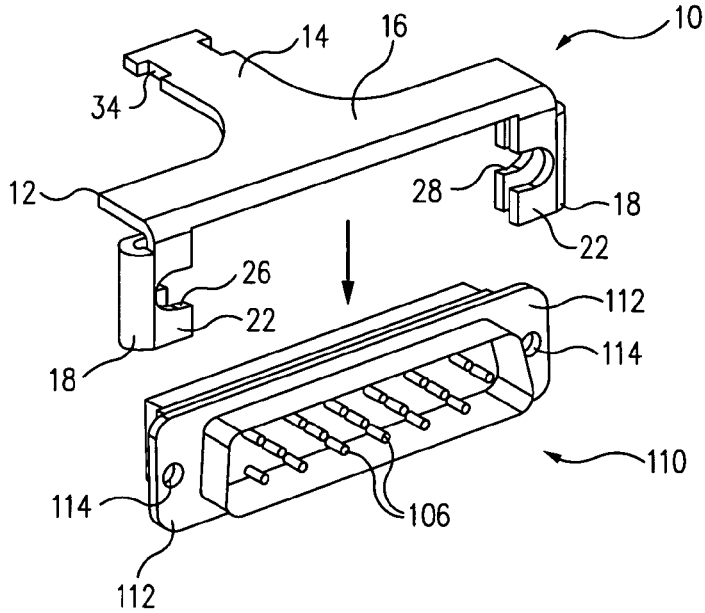

As sequentially illustrated in FIGS. 7-9, the exemplary apparatus 10 can be quickly and easily installed on a wiring harness 32 and an associated harness connector 110, either at the time the harness is fabricated or at any time thereafter, without the necessity of removing all of the wires or contacts from the connector, in accordance with the following procedure. The apparatus is first disposed on the harness connector such that the transverse member 16 of the plate 12 overlies the connector, the U-shaped structures 18 respectively straddle a corresponding mounting flange 112 of the connector, and a distal end portion of the axial member 14 of the plate overlies a portion of the harness extending rearward from the connector in a generally parallel relationship (see FIG. 8).

The apparatus 10 is then slipped down over the connector 110, in the direction of the arrow shown in FIG. 8, such that the mounting flanges 112 of the connector are respectively disposed between the respective front and rear flanges of the U-shaped structures. A mounting fastener 118 is then inserted through each of the connector flange apertures 114 and the corresponding slots 28 of the rear flanges 24 of the U-shaped members 18, as illustrated in FIG. 9, and is preferably captivated therein, e.g., by the provision of complementary threads in the apertures 114 of the connector mounting flanges, or with, e.g., a plate nut (not illustrated), such that a front surface of each of the rear flanges of the U-shaped structures is held against a rear surface of the corresponding connector mounting flange. The portion of the harness that extends rearward from the connector is then firmly cinched to the distal end portion of the axial member 14 of the plate 12 with, e.g., one or more tying straps, lacing tapes or compressive bands 36 of a known type, to provide robust strain relief between the harness and the connector, as illustrated in FIGS. 10-13.

The exemplary apparatus 10 can be produced by a wide variety of manufacturing Techniques. For example, The apparatus can be inexpensively die-stamped from a sheet of metal, e.g., a mild steel or an aluminum alloy, as a single piece, and then formed up with simple, inexpensive bending tooling and fixtures. Additionally, the apparatus can easily be protected against corrosion by, e.g., salt air, by the provision of an inexpensive protective finish, e.g., cadmium plating or anodizing.

By now, those of skill in this art will appreciate that many modifications, substitutions and variations can be made in and to the materials, apparatus, configurations and methods of the wiring harness connector strain relief apparatus of the present invention without departing from its spirit and scope. For example, it may be noted that both the strain relief apparatus 10 and the harness connector 110 are bilaterally symmetrical, and accordingly, the apparatus can be attached to either the upper or lower surfaces of the connector with equal facility, thereby affording an enhanced degree of flexibility in the layout of the wiring harness.

Similarly, while the apparatus has been described as useful in combination with D-sub connectors, skilled practitioners will appreciate that the apparatus can, with suitable modifications, be used advantageously with other types of connectors, as well. Accordingly, the scope of the present invention should not be limited to that of the particular embodiments illustrated and described herein, as they are but exemplary in nature, but instead, should be fully commensurate with that of the claims appended hereafter and their functional equivalents.

What is claimed is:

1. Apparatus for providing strain relief between an electrical connector and a wiring harness having one or more wires or cables joined to contacts of the connector, comprising:

a solid plate having a length and width respectively corresponding to a length and width of the connector;

a pair of opposing, oppositely facing U-shaped structures respectively disposed at opposite sides of the plate, the structures depending from a front edge of the plate and perpendicularly to a plane thereof, each of the U-shaped structures including a pair of parallel, inwardly directed, front and rear flanges spaced apart so as to receive a corresponding mounting flange of the connector therebetween; and, an elongated member coplanar with and extending rearward from a rear edge of the plate, the member being located so as to overlie a potion of the harness extending rearward from the connector in a generally parallel relationship.

2. The apparatus of claim 1, wherein an intersection between the plate and the elongated member defines a radius on opposite sides of the member.

3. The apparatus of claim 1, wherein the connector is a D-sub connector.

4. The apparatus of claim 1, wherein each connector mounting flange contains an aperture for a fastener, and wherein each of the front and rear flanges of each U-shaped structure includes a slot that is aligned with a corresponding one of the apertures when the corresponding connector flange is disposed therebetween.

5. The apparatus of claim 4, wherein the slot of the front flange of each U-shaped structure is larger than the slot of the rear flange thereof.

6. The apparatus of claim 1, wherein at least one of the plate, the U-shaped structures and the elongated member is stamped from a metal sheet.

7. The apparatus of claim 4, wherein the plate, the U-shaped structures and the elongated member are formed integral to each other.

8. The apparatus of claim 7, wherein the plate, the U-shaped structures and the elongated member are die stamped from a metal sheet.

9. The apparatus of claim 1, wherein the elongated member includes a pair of notches in opposite sides and adjacent to a distal end thereof.

10. The apparatus of claim 1, further comprising a protective coating on an exterior surface thereof.

11. A method for providing strain relief between an electrical connector and a wiring harness having one or more wires or cables joined to contacts of the connector, the method comprising:

providing a strain relief apparatus in accordance with claim 1;

disposing the apparatus on the connector such that the plate of the apparatus overlies the connector, the front and rear flanges of each U-shaped structure are respectively disposed in front of and behind a corresponding mounting flange of the connector, and the elongated member overlies a portion of the harness extending rearward from the connector in a generally parallel relationship;

holding a front surface of the rear flange of each U-shaped structure against a rear surface of the corresponding connector mounting flange; and, cinching a portion of the harness extending rearward from the connector to a distal end portion of the elongated member of the apparatus.

12. A wiring harness, comprising:

an electrical connector having a pair of mounting flanges disposed on opposite sides thereof;

a bundle of wires respectively connected to contacts of the connector;

a strain relief apparatus comprising a solid plate having an elongated member extending rear-ward from the plate and two-U shaped structures disposed on opposite sides thereof, each opposing, oppositely facing U-shaped structure having a front flange and a rear flange, the apparatus being disposed on the connector such that the plate overlies the connector, the front and rear flanges of each U-shaped structure are respectively disposed in front of and behind a corresponding one of the connector mounting flanges, and the elongated member overlies a portion of the harness extending rearward from the connector in a generally parallel relationship;

means for holding a front surface of the rear flange of each U-shaped structure to a rear surface of the corresponding connector mounting flange; and, means for cinching a portion of the bundle of wires extending rearward from the connector to a distal end portion of the elongated member of the apparatus.

13. Apparatus for providing strain relief between an electrical connector having mounting flanges on opposite sides thereof and a wiring harness having one or more wires or cables joined to contacts of the connector, comprising:

a solid T-shaped plate having an axial member and a transverse member; and, a pair of inwardly facing, U-shaped structures disposed in opposition to each other at opposite ends of the transverse portion and extending at a right angle to the plate from a front edge thereof, each of the U-shaped structures including a pair of parallel front and rear flanges spaced apart so as to straddle a corresponding mounting flange of the connector.

14. The apparatus of claim 13, wherein the connector is a D-sub connector.

15. The apparatus of claim 13, wherein:

each connector mounting flange contains an aperture for a fastener;

each of the front and rear flanges of each of the U-shaped structures includes a U-shaped slot that is aligned with a corresponding one of the apertures when a corresponding connector flange is disposed between the flanges; and, the slot of the front flange of each of the U-shaped structures is larger than the slot of the rear flange thereof.

16. The apparatus of claim 15, further comprising a fastener extending through a connector flange aperture and a corresponding apparatus rear flange slot and captivated therein so as to hold a front surface of the rear flange against a rear surface of the connector flange.

17. The apparatus of claim 13, wherein an intersection between the axial and the transverse members of the plate forms a radius on opposite sides of the axial member.

18. The apparatus of claim 13, wherein the elongated member includes a pair of notches in opposite sides and adjacent to a distal end thereof.

19. A method for providing strain relief between an electrical connector having mounting flanges with a fastening aperture on opposite sides thereof and a wiring harness having one or more wires or cables joined to contacts of the connector, the method comprising:

providing a strain relief apparatus, comprising a solid T-shaped plate having an axial member, a transverse member, and a pair of inwardly facing, U-shaped structures disposed in opposition to each other at opposite ends of the transverse member and extending at a right angle to the plate from a front edge thereof, each of the U-shaped structures including a pair of parallel front and rear flanges spaced apart so as to straddle a corresponding mounting flange of the connector, each of the front and rear flanges including a U-shaped slot that is aligned with a corresponding fastening aperture when a corresponding connector flange is disposed between the flanges, and the slot of the front flange of each of the U-shaped structures being larger than the slot of the rear flange thereof;

disposing the apparatus on the connector such that:

the transverse member of the apparatus overlies the connector, the U-shaped structures respectively straddle a corresponding mounting flange of the connector, and a distal end portion of the axial member of the plate overlies a portion of the harness extending rearward from the connector in a generally parallel relationship;

inserting a fastener through each of the connector flange apertures and corresponding apparatus rear flange slots;

captivating the fasteners in the respective connector flange apertures and corresponding apparatus rear flange slots such that a front surface of the rear flange is held against a rear surface of the corresponding connector flange; and, cinching the portion of the harness extending rearward from the connector to the distal end portion of the axial member of the apparatus.

20. A wiring harness having strain relief provided between an electrical connector and one or more wires or cables joined to contacts of the connector in accordance with the method of claim 19.

* * * * *